US009227815B2

(12) United States Patent
Martinelli et al.

(10) Patent No.: US 9,227,815 B2
(45) Date of Patent: Jan. 5, 2016

(54) SELECTIVE ELEVATOR BRAKING DURING EMERGENCY STOP

(75) Inventors: Roger Martinelli, Zurich (CH); Robert Stalder, Zurich (CH)

(73) Assignee: INVENTIO AG, Hergiswil NW (CH)

( * ) Notice: Subject to any disclaimer, the term of this patent is extended or adjusted under 35 U.S.C. 154(b) by 878 days.

(21) Appl. No.: 13/514,637

(22) PCT Filed: Nov. 11, 2010

(86) PCT No.: PCT/EP2010/067331

§ 371 (c)(1),
(2), (4) Date: Oct. 9, 2012

(87) PCT Pub. No.: WO2011/069773

PCT Pub. Date: Jun. 16, 2011

(65) Prior Publication Data

US 2013/0105248 A1 May 2, 2013

(30) Foreign Application Priority Data

Dec. 11, 2009 (EP) ..... 09178871

(51) Int. Cl.
*B66B 1/32* (2006.01)

(52) U.S. Cl.
CPC ..... *B66B 1/32* (2013.01)

(58) Field of Classification Search
CPC ..... B66B 1/32
USPC ..... 187/247, 277, 281, 288, 293, 391, 393
See application file for complete search history.

(56) References Cited

U.S. PATENT DOCUMENTS

| | | | | |
|---|---|---|---|---|
| 5,244,060 | A | 9/1993 | Tanaka et al. | |
| 5,323,878 | A | 6/1994 | Nakamura et al. | |
| 5,945,644 | A * | 8/1999 | Jang | 187/296 |
| 5,969,303 | A * | 10/1999 | Piserchia et al. | 187/297 |
| 6,325,179 | B1 * | 12/2001 | Barreiro et al. | 187/393 |
| 8,439,168 | B2 * | 5/2013 | Kondo et al. | 187/295 |
| 8,869,945 | B2 * | 10/2014 | Harkonen et al. | 187/288 |
| 2010/0258382 | A1 * | 10/2010 | Kondo et al. | 187/288 |
| 2015/0053507 | A1 * | 2/2015 | Kattainen et al. | 187/288 |

FOREIGN PATENT DOCUMENTS

GB 2 153 465 A 8/1985

* cited by examiner

*Primary Examiner* — Anthony Salata
(74) *Attorney, Agent, or Firm* — Ladas & Parry LLP

(57) ABSTRACT

A method for controlling movement of an elevator car during an emergency stop includes the steps of determining the load of the car; determining the travel direction of the car; and monitoring the speed of the car. When the car is determined to be either lightly loaded and travelling downwards, or heavily loaded and travelling upwards, brake torque is applied only when the speed of the car reaches zero, as slowing of the car can be accomplished solely by virtue of the balancing factor of the car's counterweight.

11 Claims, 3 Drawing Sheets

SELECTIVE ELEVATOR BRAKING DURING EMERGENCY STOP

BACKGROUND OF THE INVENTION

In an elevator installation, an elevator car and a counterweight are conventionally supported on and interconnected by traction means. The traction means is driven through engagement with a motor-driven traction sheave to move the car and counterweight in opposing directions along the elevator hoistway. The drive unit, consisting of the motor, an associated brake and the traction sheave, is normally located in the upper end of the elevator hoistway or alternatively in a machine room directly above the hoistway.

Safety of the elevator is monitored and governed by means of a safety circuit or chain containing numerous contacts or sensors. Such a system is disclosed in U.S. Pat. No. 7,353,916. Should one of the safety contacts open or one of the safety sensors indicate an unsafe condition during normal operation of the elevator, the controller instructs the drive to perform an emergency stop by immediately de-energizing the motor and applying the brake. The elevator cannot be called back into normal operation until the reason for the break in the safety circuit has been investigated and the relevant safety contact/sensor reset.

Traditionally, steel cables have been used as traction means. More recently, synthetic cables and belt-like traction means comprising steel or aramid cords of relatively small diameter coated in a synthetic material have been developed. An important aspect of these synthetic traction means is the significant increase in the coefficient of friction they exhibit through engagement with the traction sheave as compared to the traditional steel cables. Due to this increase in relative coefficient of friction, when the brake is applied in an emergency stop for an elevator employing synthetic traction means there is an significant increase in the deceleration of the car which severely degrades passenger comfort and could even result in injury to passengers.

GB-A-2153465, U.S. Pat. No. 5,323,878 and U.S. Pat. No. 5,244,060 all describe methods of controlling the movement of an elevator car during an emergency stop wherein the brake is automatically and immediately applied but the degree of the brake force or torque exerted by the brake is dependent on the load of the car. These methods help reduce deceleration of the elevator car during an emergency stop.

BRIEF DESCRIPTION OF THE INVENTION

An objective of the present invention is to further reduce the deceleration of an elevator car during an emergency stop so as to alleviate the problems discussed above. A further objective is to reduce wear of the brake. These objectives are achieved by a method for controlling movement of an elevator car during an emergency stop comprising the steps of determining a load of the car, determining a travel direction of the car, monitoring a speed of the car and when the car is travelling downwards and is lightly loaded or when the car is travelling upwards and is heavily loaded, applying brake torque when the speed of the car reaches zero. Accordingly, in these two emergency stops conditions, brake torque is only applied to secure the car in a stationary position and not while the car is moving and therefore deceleration experienced by any passenger is reduced. Additionally, since the brakes are not used to decelerate the moving elevator car, brake wear is inherently reduced thereby improving the lifespan of the brake.

Preferably, the car is judged to be lightly loaded, intermediately loaded or heavily loaded.

With an intermediate load the car is more balanced with the counterweight than in the lightly loaded or heavily loaded conditions. Accordingly, if the car is intermediately loaded it is not necessary to apply the total brake torque available since a partial brake torque is sufficient to slow down the car. Preferably, once the car has been brought to a halt full brake torque is applied to secure the car in a stationary position.

If the car is travelling downwards and the car is heavily loaded, full brake torque is applied immediately. Similarly, if the car is travelling upwards and the car is lightly loaded, full brake torque is applied immediately.

The balancing factor between the car and counterweight is the key factor in determining the intermediate load range. If a 40% balancing factor is utilised, the car is judged to be intermediately loaded when its load falls within the range of 30-60% of rated load inclusively or, more preferentially, in the 40-60% range.

Preferably, the method for controlling movement of the elevator car during an emergency stop further includes the step of de-energizing a motor driving the car.

The car can be selectively braked by activating a first brake set alone to provide partial brake torque or by activating the first and a second brake set to provide full brake torque.

Alternatively, partial brake torque may be provided electrically by a motor used within the elevator to drive the interconnected car and counterweight whereas full brake torque can be provided by at least one brake set.

BRIEF DESCRIPTION OF THE VIEWS OF THE DRAWINGS

The invention is herein described by way of specific examples with reference to the accompanying drawings of which.

DETAILED DESCRIPTION OF THE INVENTION

Figure 1:
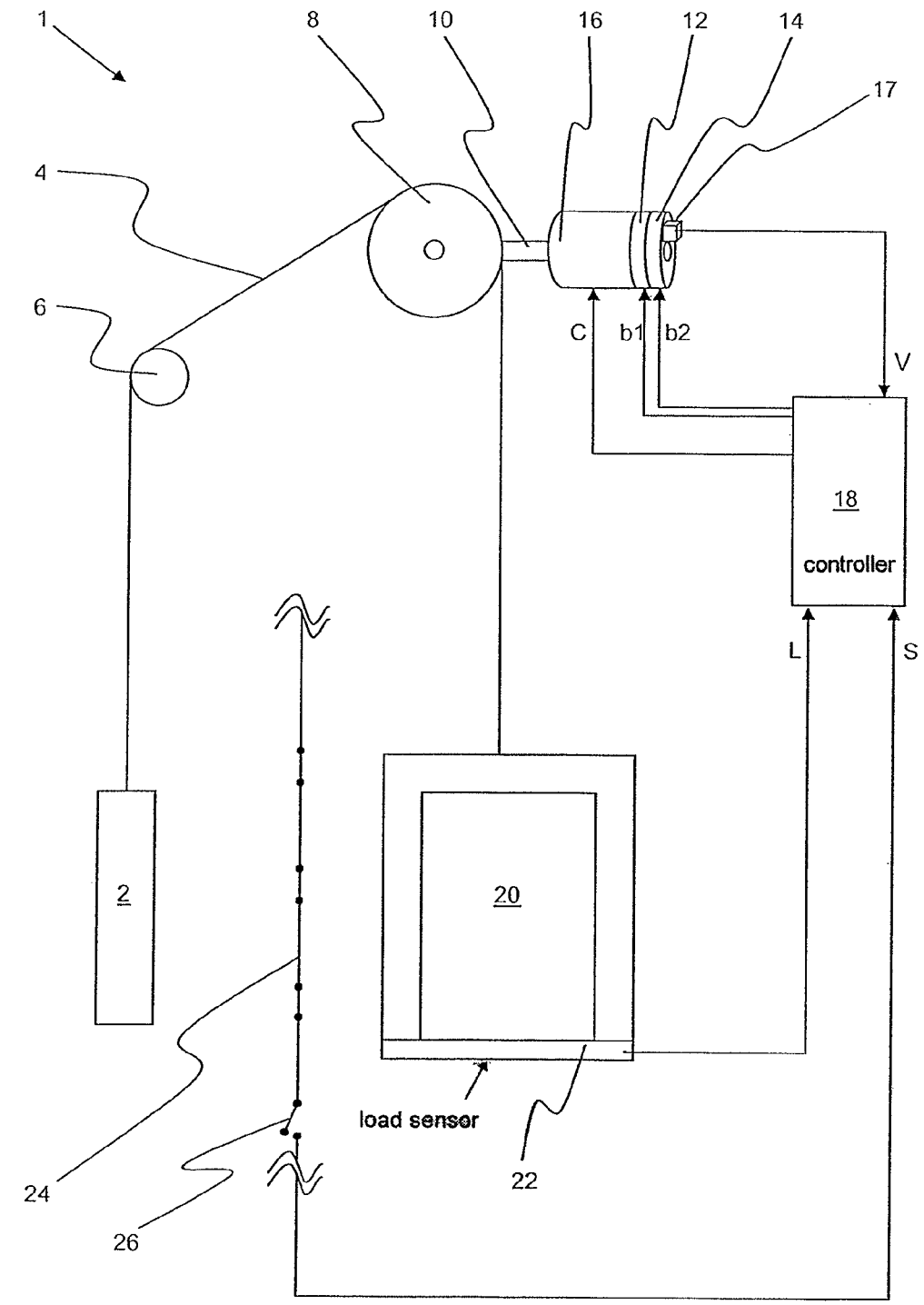
FIG. 1 is a schematic of an elevator installation according to the present invention.

An elevator installation 1 according to the invention is shown in FIG. 1. The installation 1 is generally defined by a hoistway bound by walls within a building wherein a counterweight 2 and car 20 are movable in opposing directions along guide rails. Suitable traction means 4 supports and interconnects the counterweight 2 and the car 20. In the present embodiment the weight of the counterweight 2 is equal to the weight of the car 20 plus 40% of the rated load which can be accommodated within the car 20. The traction means 4 is fastened to the counterweight 2 at one end, passed over a deflecting pulley 6 positioned in the upper region of the hoistway, passed through a traction sheave 8 also located in the upper region of the hoistway, and fastened to the elevator car 20. Naturally, the skilled person will easily appreciate other roping arrangements are equally possible. The traction sheave 8 is driven via a drive shaft 10 by a motor 16 and braked by an electro-mechanical brake having a first brake set 12 and a second brake set 14. The use of at least two brake sets is compulsory in most jurisdictions (see, for example, European Standard EN81-1:1998 12.4.2.1). The traction sheave 8, drive shaft 10, motor 16 and brake sets 12,14 form the drive unit of the elevator. Motion of the drive unit is controlled and regulated by command signals C,b1,b2 from an elevator controller 18.

The safety of the elevator is monitored and governed by means of a safety circuit 24 containing numerous contacts or sensors. Should any one of these safety contacts open during normal operation of the elevator, as depicted by the bottom contact 26 in FIG. 1, the signal S from the safety circuit 24 indicates to the controller 18 that an unsafe or possibly hazardous condition has occurred. Thereafter, controller 18 immediately initiates an emergency stop which will be discussed in more detail below.

A load sensor 22 mounted on or within the car 20 supplies a load signal L to the controller 18. Such a load signal L is conventionally used by the elevator controller 18 for numerous reasons which include identifying an overload condition when too many passengers have boarded the stationary car 20 at an elevator landing and also pre-torquing the motor 16 before a trip so that every journey commences safely and smoothly. In the present embodiment, the controller 18 determines from the load signal L whether the car 20 is lightly loaded (less than 30% of rated load), intermediately loaded (between 30 and 60% of rated load inclusively) or heavily loaded (greater than 60% of rated load).

From a signal V feed from an encoder 17 mounted on the drive unit, the controller 18 can determine the speed of the traction sheave 8 and thereby the speed of the car 20.

Figure 2:
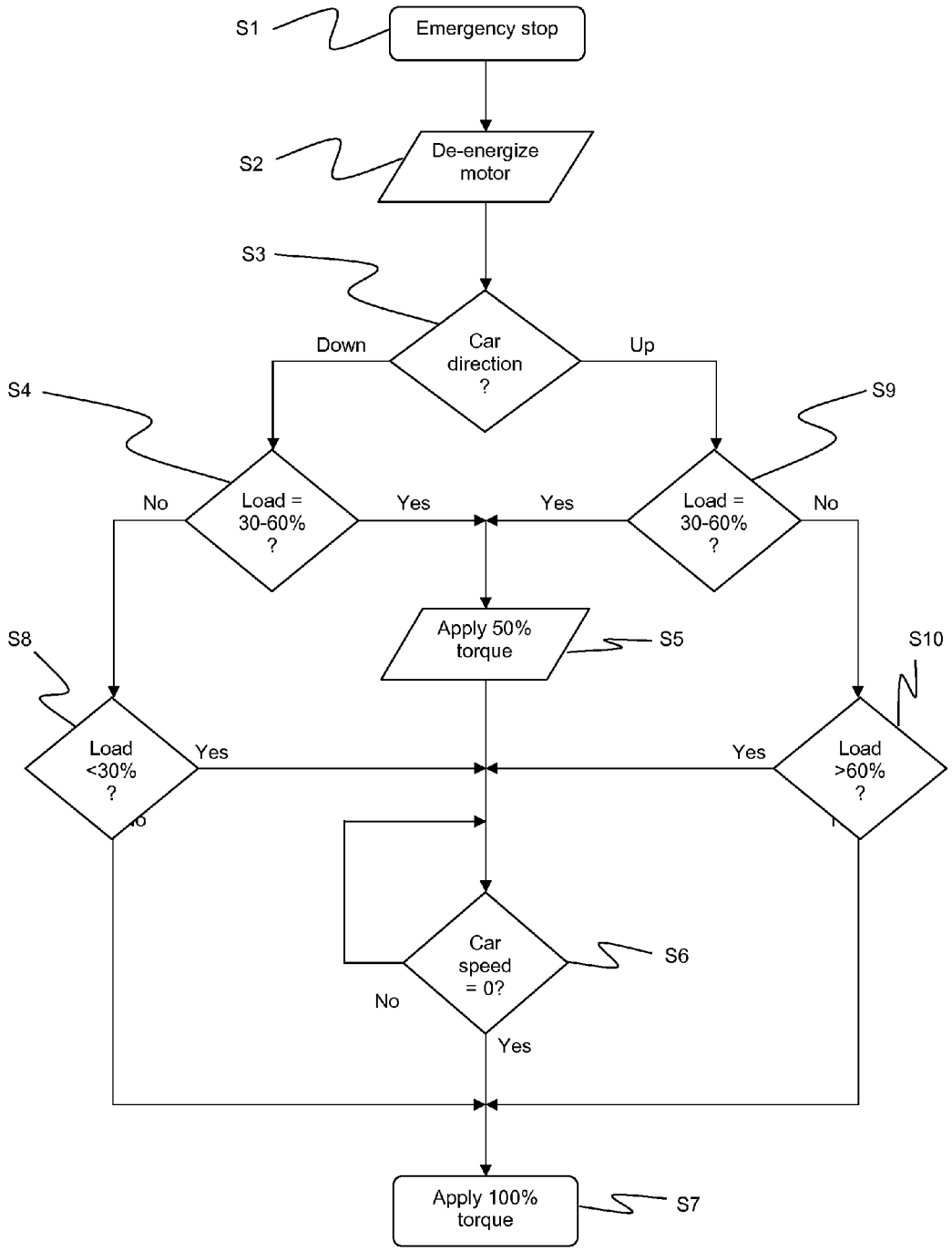
FIG. 2 is a flowchart illustrating the process steps of a method according to a first embodiment of present invention.

The procedure undertaken by the controller 18 in an emergency stop is depicted in the flowchart of FIG. 2. When the controller 18 determines from the signal S provided by the safety circuit 24 that an unsafe or possibly hazardous condition has occurred it immediately initiates an emergency stop in step S1. In step S2, the controller 18 issues a command signal C to de-energize the motor 16. In step S3, the controller 18 determines the direction in which the car 20 is travelling.

If the car 20 is travelling downwards, the procedure progresses to step S4 where the controller 18 determines from the load signal L whether the car 20 is intermediately loaded. If so, the sequence progresses to step S5 where the controller 18 issues a first brake command signal b1 to engage the first brake set 12 which provides approximately 50% of the total brake torque available within the drive unit. In step S6, the procedure loops until the controller 18, using the signal V from the encoder 17, determines that the car speed has been reduced to zero. Then, in step S7, the controller 18 applies 100% of the total brake torque available within the drive unit. In the present example, since the first brake set 14 was already applied in step S5, the controller 18 need only issue a second brake command signal b2 to bring the second brake set 14 into engagement and therefore provide 100% of the available brake torque.

The alternative outcome for the determination of step S4 is that the car 20 is not intermediately loaded in which case the sequence progresses to step S8 wherein the controller 18 determines whether the car 20 is lightly loaded. If the response is affirmative, then the procedure progresses to step S6 as discussed above. Although neither of the brake sets 12,14 has been applied at this stage of the sequence, the car 20 will automatically decelerate and eventually stop moving downwards during step S6 due to the imbalance between the car 20 and the counterweight 2. The counterweight 2 is heavier in relative terms to the car 20 and its load and therefore the net force acts to decelerate the downwardly moving car 20. Once the car 20 has stopped in step S6 the procedure progresses to step S7. If the response from step S8 is negative, indicating that the car 18 is heavily loaded, then the procedure progresses to step S7. No matter whether the outcome from step S8 is affirmative or negative, when the sequence eventually reaches step S7, in order to apply 100% of the total brake torque available as required in step S7, the controller 18 issues the first and second brake command signals b1,b2 since neither brake set 12,14 has previously been applied.

The alternative outcome for the determination of step S3 is that the car 20 is travelling upwards. In this case the procedure progresses to step S9 where the controller 18 determines from the load signal L whether the car 20 is intermediately loaded. If so, the sequence progresses to step S5 as discussed above.

If it is determined in step S9 that the car 20 is not intermediately loaded, in step S10 the controller 18 determines whether the car 20 is heavily loaded. If the response is affirmative, then the procedure progresses to step S6 discussed above. Although neither of the brake sets 12,14 has been applied at this stage of the sequence, the car 20 will automatically decelerate and eventually stop moving upwards during step S6 due to the imbalance between the car 20 and the counterweight 2. In this instance, the counterweight 2 is lighter in relative terms to the car 20 and its load and therefore the net force acts to decelerate the upwardly moving car 20. Once the car 20 has stopped in step S6 the procedure progresses to step S7. If the response from step S10 is negative, indicating that the car 18 is lightly loaded, then the procedure progresses to step S7. No matter whether the outcome from step S10 is affirmative or negative, when the sequence eventually reaches step S7, in order to apply 100% of the total brake torque available as required in step S7, the controller 18 issues the first and second brake command signals b1,b2 since neither brake set 12,14 has previously been applied.

Figure 3:
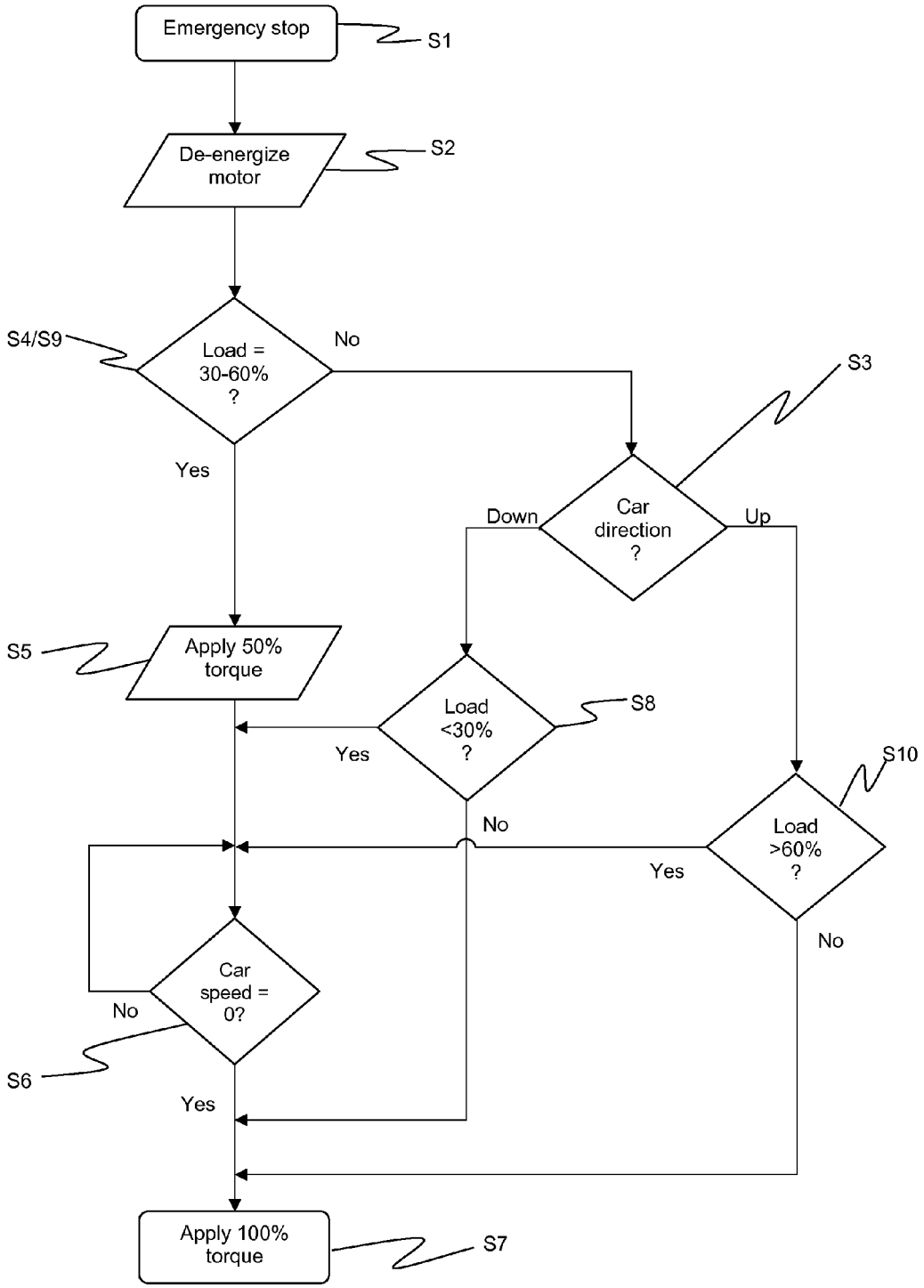
FIG. 3 is a flowchart illustrating the process steps of a method according to a second embodiment of present invention.

The skilled person will readily recognise that the sequence of the steps depicted in FIG. 2 can be altered without affecting the outcome of the braking procedure. For example, if the controller 18 determines that the car 20 is intermediately loaded in step S4 or step S9 then the procedure is exactly the same whether the car 20 is travelling downwards or upwards in the hoistway as determined in step S3. Accordingly, the positions of step S4/S9 and step S3 in the sequence can be interchanged as illustrated in FIG. 3.

Instead of mounting the brake sets 12,14 within the drive unit as depicted in FIG. 1, they could be mounted on the car so as to frictionally engage the guide rails to bring the car to a halt. Similarly, any type sensor from which the controller 18 can derive the car speed can be used instead of the encoder 17.

The skilled person will also appreciate that as an alternative to using the first brake set 12 to provide the required partial brake torque in step S5, the controller 18 can instead issue a command signal C instructing the motor 16 to electrically brake the traction sheave 8 and thereby supply the partial brake torque required in step S5 to bring the car 20 to a halt.

Although the present invention is has been developed, in particular, for use in conjunction with synthetic traction means, it can equally be applied to any elevator to reduce the deceleration of an elevator car during an emergency stop and thereby improve passenger comfort.

Furthermore, as an alternative to mounting the drive unit in the upper region of the hoistway as depicted in FIG. 1, the car and counterweight could be supported at opposite ends of suspension means passed over a passive deflecting pulley positioned in the upper region of the hoistway while a drive unit mounted in the lower region of the hoistway is used to drive a traction means interconnecting but suspended beneath the car and counterweight.

Although a balancing factor of 40% of rated load is quoted in the description above, any balancing factor can be used although a range of 0-50% of rated load is preferable for most applications.

The invention claimed is:

1. A method for controlling movement of an elevator car during an emergency stop comprising the steps of determining a load of the car, determining a travel direction of the car, monitoring a speed of the car and when the car is travelling downwards and is lightly loaded or when the car is travelling upwards and is heavily loaded, applying brake torque when the speed of the car reaches zero.

2. A method according to claim 1 wherein, if the car is intermediately loaded, a partial brake torque is applied to brake the car.

3. A method according to claim 2 further comprising the step of applying full brake torque when the speed reaches zero.

4. A method according to claim 1 wherein, if the car is travelling downwards and the car is heavily loaded, full brake torque is applied.

5. A method according to claim 1 wherein, if the car is travelling upwards and the car is lightly loaded, full brake torque is applied.

6. A method according to claim 1 wherein the car is judged to be lightly loaded, intermediately loaded or heavily loaded.

7. A method according to claim 6 wherein the car is judged to be intermediately loaded when its load falls within the range of 30-60% of rated load inclusively.

8. A method according to claim 7 wherein the car is judged to be intermediately loaded when its load falls within the range of 40-60% of rated load inclusively.

9. A method according to claim 1 further comprising the step of de-energizing a motor driving the car.

10. A method according to claim 3 wherein the car is selectively braked by activating a first brake set alone to provide partial brake torque or by activating the first and a second brake set to provide full brake torque.

11. A method according to claim 3 wherein partial brake torque is provided electrically by a motor used to drive the car and full brake torque is provided by at least one brake set.

* * * * *